United States Patent [19]

Vignier

[11] 4,207,573

[45] Jun. 10, 1980

[54] DUAL-FREQUENCY ANTENNA SYSTEM WITH COMMON REFLECTOR ILLUMINATED BY DIFFERENT FEEDS

[75] Inventor: Claude Vignier, Paris, France

[73] Assignee: Thomson-CSF, Paris, France

[21] Appl. No.: 906,860

[22] Filed: May 17, 1978

[30] Foreign Application Priority Data

May 18, 1977 [FR] France ..... 77 15305

[51] Int. Cl.[2] ..... H01Q 1/52

[52] U.S. Cl. ..... 343/727; 343/779; 343/835; 343/885

[58] Field of Search ..... 343/725, 727, 730, 779, 343/781 R, 781 CA, 835, 840, 885

[56] References Cited

U.S. PATENT DOCUMENTS

| | | | |
|---|---|---|---|
| 3,031,665 | 4/1962 | Marié | 343/770 |
| 3,176,301 | 3/1965 | Wellons | 343/840 |
| 3,803,617 | 4/1974 | Fletcher | 343/730 |

FOREIGN PATENT DOCUMENTS

| | | | |
|---|---|---|---|
| 1200387 | 4/1962 | Fed. Rep. of Germany | 343/727 |

*Primary Examiner*—Eli Lieberman

*Attorney, Agent, or Firm*—Karl F. Ross

[57] ABSTRACT

A dished reflector is illuminated by a primary radiation feed including a rectangular waveguide and a secondary radiation feed comprising two dipoles flanking that waveguide. In order to minimize distortion of the radiation diagram from the secondary feed by the waveguide envelope, at least one elongate corrective member paralleling the dipoles is externally mounted on that envelope and is capacitively coupled or conductively connected thereto at a location where a peripheral current induced by the dipoles is at a maximum. The corrective member, like the dipoles themselves, may be a plate with major faces lying in planes perpendicular to the waveguide axis.

12 Claims, 22 Drawing Figures

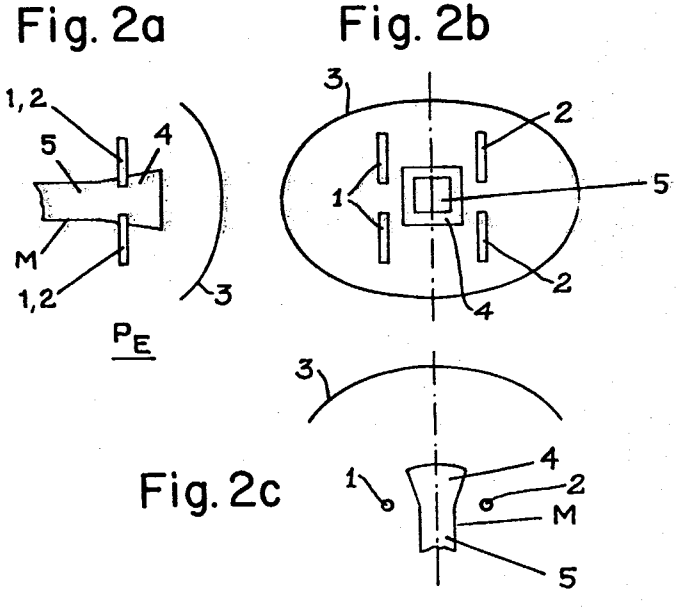
Fig. 2a
Fig. 2b
Fig. 2c
Fig. 2d
1,2
5
4
M
3
$P_E$
2
1
N
0
θ
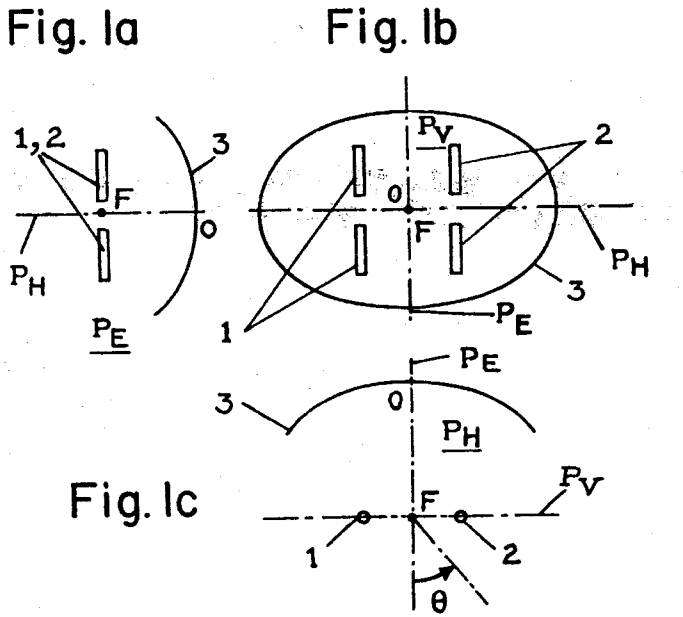
Fig. 1a
Fig. 1b
Fig. 1c
Fig. 1d
1,2
F
$P_H$
$P_E$
$P_V$
3
2
1
0
θ
N

DUAL-FREQUENCY ANTENNA SYSTEM WITH COMMON REFLECTOR ILLUMINATED BY DIFFERENT FEEDS

FIELD AND BACKGROUND OF THE INVENTION

My present invention relates in general to antennas having a plurality of independent sources of electromagnetic radiation which are used simultaneously on different wavelengths and in which there is a danger that the circuits associated with several of these sources, situated in the electromagnetic field of one such source, may distort the radiation characteristics of the latter.

More particularly, my invention relates to radar antennas which have a single reflector illuminated by two radiation sources or feeds A and B which operate simultaneously at different wavelengths $\lambda_A$ and $\lambda_B$, respectively, feed A interfering with feed B. A typical example of such antennas operating on two frequencies can be found in the combination of a surveillance system (secondary radar) with a watching or tracking radar (primary radar).

The function of the primary radar is to detect the presence of a passive object and to supply a number of items of information (range, position, speed) pertaining thereto.

The function of the secondary radar is to transmit interrogation signals which enable the object to be identified when it is fitted with a suitable transponder.

In general, the operating wavelength $\lambda_A$ of the primary radar is in the centimeter range and the wavelength $\lambda_B$ of the secondary radar in the decimeter range.

In normal use, the small value of wavelength $\lambda_A$ and also the desire to optimize the performance of the primary radar make it necessary that priority be given to producing the radiation feed for the primary radar. The phase center of this feed coincides with the focus of the reflector and is thus situated within the conductive envelope defining the space within which are propagated the waves of wavelength $\lambda_A$ used to illuminate the reflector. In the majority of cases, this metal envelope is that of the supply circuits for the feed which are formed by a waveguide terminating in a horn pointing toward the reflector. Thanks to the sheltered location of the phase center, the presence of the elements which form the feed for the radiation of wavelength $\lambda_B$ cause very little interference with the radiation of wavelength $\lambda_A$.

On the other hand, the radiation from the secondary radar, in its "interrogation" mode, may be considerably distorted by the presence of the external conductive surface of the waveguide structure associated with the feed of the primary radar.

In the "interrogation" mode, the far-field radiation diagram exhibits a maximum (the main lobe) flanked by side lobes of lower levels. Directivity is best in the horizontal or azimuth plane $P_H$. One and the same elevational plane $P_E$ contains the axes of maximum radiation of both the primary and secondary radars. Plane $P_E$ forms a vertical plane of symmetry for the two sorts of radiation.

The phase center of the feed illuminating the secondary radar must be situated in plane $P_E$ and very close to the focus of the reflector. This requirement is almost always met by dividing the feed into two similar individual sections or groups of individual radiators which are supplied in phase and which are symmetrically positioned about plane $P_E$. In the majority of cases, however, the external conductive envelope of the structure supplying energy at wavelength $\lambda_A$ to the feed of the primary radar (e.g. a waveguide terminating in a horn) has an axis situated in plane $P_E$ and the two feed sections are thus situated on either side of that envelope.

Being electromagnetically coupled to the waveguide structure, these sections induce in-phase currents in it which radiate in their turn. The two sections, on the one hand, and the waveguide envelope, on the other hand, form a combination of two active antennas energized from a supply and one passive antenna which is not energized.

On account of its structure, the radiation diagram of the waveguide envelope is very different from those of the feed sections. The result is more illumination than intended at the edges of the reflector and an abnormally uniform distribution of energy, with the following consequences:

- in the far field, a high side-lobe level;
- a not inconsiderable level of energy radiated by the waveguide envelope outside the reflector, and hence the appearance of high-level side lobes in directions well off the main axis of radiation;
- a main lobe which is deformed by reason of faulty focusing due to the displacement of the phase center;
- a loss of gain;
- a worsening of the transverse polarization factor.

It has been possible hitherto to correct these faults to some degree, during construction, by laborious mechanical and electrical adjustments arrived at by a process of trial and error, as by shifting the two feed sections, modifying their phase difference, or altering the position of the envelope.

This, however, is no more than a palliative since the method amounts to shaping the radiation diagram of the secondary radar to a more or less satisfactory form by means of a series of compensations which are valid for one structure and a given set of dimensions but which cannot form a basis for a method of correction applicable to other structures or dimensions, even if they are quite closely related.

OBJECT OF THE INVENTION

Consequently, the object of my invention is to provide a simple corrective circuit which, without altering any of the existing mechanical or electrical characteristics of the feed of the secondary radar, enables virtually the same radiation diagram to be obtained as would exist in the absence of the conductive envelope of the guide structure supplying energy at the wavelength $\lambda_A$ to the feed of the primary radar.

SUMMARY OF THE INVENTION

An antenna system of the aforedescribed type, with primary feed means including a conductive structure establishing a predetermined propagation path for radiation of a first frequency (corresponding to wavelength $\lambda_A$) and with elongate secondary feed means skew to that path establishing a field of radiation of a second frequency (corresponding to wavelength $\lambda_B$) close enough thereto to cause distortion of the radiation pattern of this latter frequency by the structure of the primary feed means, is provided pursuant to my present invention with corrective conductor means in the form of one or more members geometrically similar and parallel to the secondary feed means, the corrective member or members projecting from the primary-feed structure generally transversely to the propagation path established thereby and—in the case of at least one such member—at a location where currents induced in that structure by the field of the secondary feed means are substantially at a maximum.

In the embodiments more particularly described hereinafter, the structure of the primary feed means includes a waveguide which terminates in a mouth (generally formed by a horn) proximal to a dished reflector whose concave surface confronts both feed means for illumination thereby; the waveguide is flanked by a pair of dipoles, preferably of the center-fed half-wave type, constituting the secondary feed means. In that instance, for reasons explained hereinafter, a member or pair of members forming part of the corrective structure is advantageously secured to the guide structure at a point spaced from the guide mouth by substantially a quarter-wavelength of the second frequency, i.e. by $\lambda_B/4$.

Thanks to the conductive or possibly capacitive coupling of one or more corrective members to the guide structure in the vicinity of regions of the guide envelope where the currents induced by the secondary feed reach a maximum value, as discussed above, the stray radiation otherwise emitted by this envelope is effectively replaced by a field codirectional with that generated by the two secondary-feed sections, i.e. the dipoles flanking the guide.

By virtue of the introduction of the corrective member or members, the problem of shaping the radiation diagram is considerably simplified. It is, in fact, no longer necessary to perform painstaking mechanical or electrical alterations to the basic structure by an empirical process. The problem is reduced to the familiar one of designing an array of homologous radiators, some of which are active (the feed sections) while the others are passive (the corrective member or members).

A limited number of trails with models and routine tests enable the number of corrective elements and their position to be selected to yield a suitable radiation diagram.

BRIEF DESCRIPTION OF THE DRAWING

The above and other features of my invention will now be described in detail with reference to the accompanying drawing in which:

FIGS. *1a*, *1b* and *1c* are, respectively, a side view, a front view and a top view of a secondary-radar antenna forming part of an antenna system to which my invention is applicable;

FIG. *1d* is a radiation diagram for the antenna of FIGS. *1a–1c* operating in the "interrogation" mode;

FIGS. *2a*, *2b* and *2c* are views similar to FIGS. *1a*, *1b* and *1c*, respectively, showing the secondary-radar antenna supplemented by a primary radiation feed in the form of a waveguide terminating in a horn;

FIG. *2d* is a diagram showing the distortion of the radiation pattern of FIG. *1d* by the guide structure of FIGS. *2a–2c;*

Figure 3:
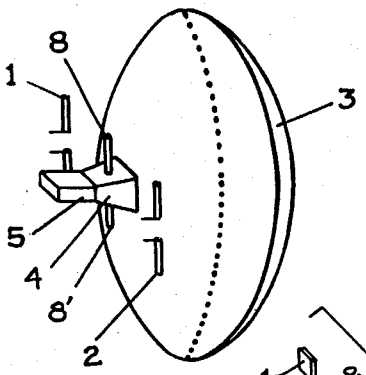
Figure 5:
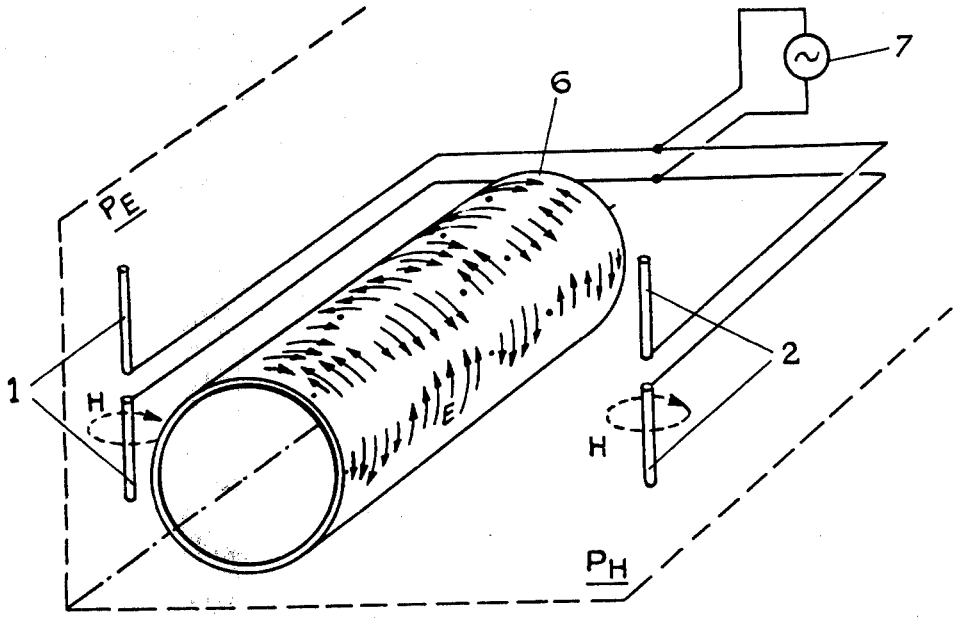

FIG. 3 is a perspective view of the assembly of FIGS. *2a–2c* incorporating corrective members according to my invention;

FIGS. *3a* and 4 are two views similar to FIG. 3, illustrating certain modifications;

FIG. 5 is a perspective view of a simplified version of the antenna system of FIGS. *2a–2c;*

FIGS. *6a* and *6b* are diagrammatic front and top views, respectively, of the simplified system of FIG. 5;

FIGS. *7a* and *7b* are a perspective view and a diagrammatic fragmentary view of the system of FIG. 5 incorporating corrective members according to my invention; and FIGS. *8a*, *8b*, *9a*, *9b*, *10a* and *10b* are fragmentary perspective views illustrating various arrangements of corrective members on rectangular waveguides forming part of the primary-feed structure.

DETAILED DESCRIPTION

FIGS. *1a*, *1b* and *1c* are diagrammatic views of a secondary-radar antenna, operating at a wavelength $\lambda_B$ of the order of 30 cm, as projected onto three mutually orthogonal planes $P_E$, $P_H$ and $P_V$.

This antenna has a reflector 3 of the orange-peel type formed by a dished portion of a paraboloid of revolution having a vertex O and a focus F. The parts of this antenna are defined in relation to the aforementioned horizontal plane $P_H$ and elevational plane $P_E$, which intersect along a straight line OF, and vertical plane $P_V$ which is normal to axis OF and includes the focus F.

The dished reflector 3, centered on vertex O, is illuminated by two half-wave ($\lambda_B/2$) dipoles 1 and 2 which are fed in phase at their midpoints, lie in the focal plane $P_V$, are normal to the horizontal plane $P_H$, and are symmetrical about the elevational plane $P_E$; the phase center of the illuminating feed coincides with focus F.

FIG. *1d* is a highly diagrammatic cartesian representation of a curve for the relative levels N of the far-field radiation from the antenna, as a function of azimuth $\theta$, in the plane $P_H$. As is well known, this curve of symmetrical form contains a central main lobe flanked by side lobes of lower levels.

FIGS. *2a*, *2b* and *2c* show projected views of the same secondary-radar antenna, but this time associated with the antenna of the primary radar which operates at a wavelength $\lambda_A$ (3 cm, for example). The feed for illuminating the latter is formed by a horn 4 supplied via a guide 5. The axis of the assembly 4, 5 virtually coincides with the line of intersection of planes $P_H$ and $P_E$. The phase center of the antenna of the primary radar is situated inside guide 4, theoretically at the focus F. Since elements 4 and 5 are within the electromagnetic field of dipoles 1 and 2, the outer surface M of these conductive elements carries induced currents which set up a secondary radiation whose geometry in space is completely different from that of the radiation from the antenna of FIG. 1.

The distorted radiation diagram resulting from the presence of conductors 4, 5 is shown in FIG. *2d*.

For the reasons already explained above, there occurs:

- deformation and widening of the main lobe due to displacement of the phase center;
- a loss of gain;
- an increase in the level of the side lobes;
- the appearance of high-level side lobes at large azimuth angles, due to the fact that envelope surface M radiates considerable energy outside the reflector 3.

In order that the principle of the corrective arrangement according to my invention may be properly understood, it is essential to examine the structure of the electromagnetic fields induced at the surface M. It is possible to draw up a diagram for the operation of the system and to make calculations by selecting a simple geometrical shape which is close to reality. In the present case I have selected a cylindrical surface of circular cross-section. The qualitative conclusions drawn from an analysis of this simple case will serve as guides in examining the more complicated shape illustrated in FIGS. 2a–2c, i.e. a rectangular waveguide terminating in a horn.

FIG. 5 depicts the elementary case of an open cylinder 6 of radius r, positioned midway between two half-wave dipoles 1 and 2 which are supplied in phase by a voltage source 7, as a fairly good simulation of the actual case shown in FIGS. 2a–2c.

Figure 6A:
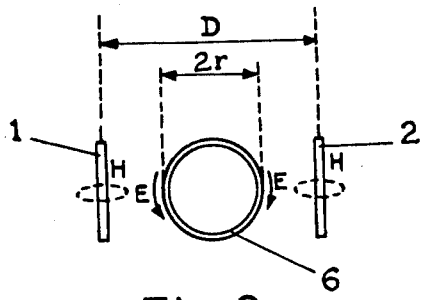

The axis of cylinder 6 coincides with the line of intersection of the two planes $P_H$ and $P_E$. The dipoles are separated by a distance D (see FIG. 6a). The surface of structure 6 may be considered subdivided into a series of annular slices. Each slice forms a conductive ring carrying a current due to an electric field E induced by the magnetic field H of either dipole (the lines of force of fields E and H are indicated in FIG. 5).

Figure 6B:
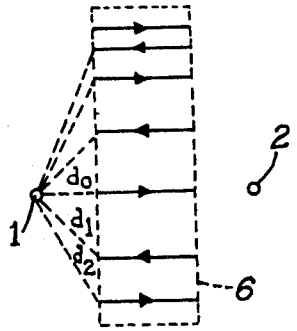

If the distances separating the dipole 1, for example, from the several rings are designated $d_0$, $d_1$, $d_2$ etc. (see FIG. 6b), it will be seen that all the rings at distances $d_{2p}=(D/2-r)+2p\lambda_B/2$ (p=0, 1, 2, . . . n) carry cophasal peripheral currents of one polarity and that all the rings at distances $d_{2p+1}=(D/2-r)+(2p+1)\lambda_B/2$ carry cophasal peripheral currents of the opposite polarity.

If the cylinder 6 were of considerable length, the strength of the inducing fields would diminish in inverse proportion to distances $d_0$, $d_1$, $d_2$ etc. However, owing to the magnetic coupling between the rings of current this fall-off as a function of distance would be compensated and current density would remain virtually constant along a given generatrix of cylinder 6. In the actual instance here envisaged, where the cylinder is of limited length, there occurs a standing distribution of the currents along the cylinder generatrices with alternating nodes and antinodes.

Since the open end of cylinder 6 represents a current node, the first antinode is situated approximately $\lambda_B/4$ from this end, and the next antinodes occur at $3\lambda_B/4$, $5\lambda_B/4$, and so on. The "annular current antinodes" may be likened to a row of feeds distributed along structure 6.

This row produces interference radiation whose geometry is greatly different from that of the radiation from dipoles 1 and 2 unaffected by the presence of structure 6. The direction of this interfering radiation needs to be controlled and it is precisely this which is the object of the present invention. To allow such control to be exerted, a member in the form of a conductive rod 8 whose length is close to $\lambda_B/4$ is welded at one end to the surface of cylinder 6 close to an annular current antinode (see FIG. 7a). Rod 8, which is parallel to the dipoles 1 and 2 and lies in the plane $P_E$, radiates omnidirectionally in a plane which is perpendicular to its axis and thus parallel to plane $P_H$, but with a certain amount of directivity which favors this plane over other directions. Since the surface current is at a maximum at the point of the welded joint, that is to say at the base of rod 8, the potential gradient between its free end and the neighboring annular antinodes is also at a maximum. The capacitance $\gamma$ (FIG. 7b) between the free end of rod 8 and the annular antinodes may be adjusted to ensure that the corrective member is more satisfactorily matched, for example by means of a metal disc or sphere welded to that free end. Such enlargements have been illustrated at 9, 9′ in FIG. 7b.

The corrective rod 8 thus performs the desired function of converting the wrongly oriented interference radiation into radiation of the same kind as that from dipoles 1 and 2.

Figure 7A:
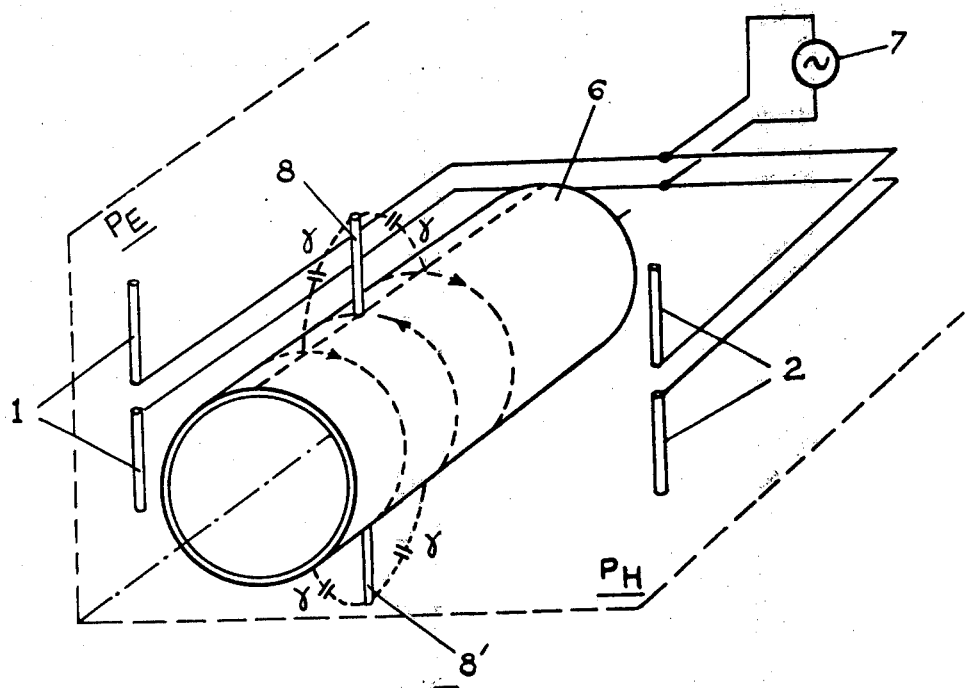
Figure 7B:
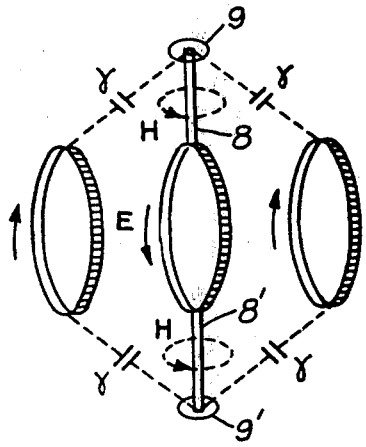

In the case of FIG. 5, where the axis of the cylinder 6 lies in the plane $P_H$ which is presumed to contain the focus of the reflector, it may be necessary to install a second corrective rod 8′ which is symmetrical to rod 8 about plane $P_H$ as illustrated in FIGS. 7a and 7b.

I have found that usually a single rod 8 or a single pair of rods 8, 8′ is sufficient for satisfactory correction. It is possible to adapt the transformed radiation (directivity, phase, polarization) by welding secondary rods similar to the main rod 8 (or 8′) along the same generatrix of the cylinder 6 in the vicinity of the other annular antinodes.

Since the radiation from all the rods 8, 8′ almost completely replaces that from the cylinder 6, the problem is reduced to that of an array of individual feeds of the same nature, some of which are active (dipoles 1 and 2) while the others are passive.

This method of adapting the radiation diagram is also very versatile since, apart from rod 8, the secondary rods need not necessarily be welded in place exactly at a current antinode. It is thus possible to graduate the current energizing each of the rods and its phase shift with respect to rod 8.

Figure 3A:
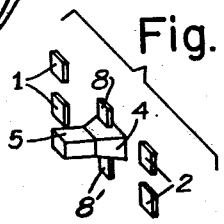

FIG. 3 shows the skeleton of the antenna of FIG. 2 provided with two corrective rods 8 and 8′ according to the invention. These rods are welded in place close to the first current antinode situated at approximately $\lambda_B/4$ from the opening of the horn 4. In order not to distort the radiation of the primary radar, the corrective rods 8 and 8′, and also the dipoles 1 and 2, are advantageously metal plates with major sides parallel to plane $P_V$ whose width is close to $\lambda_A/2$ as illustrated in FIG. 3a. It is also possible, however, to use slender cylindrical rods for members 1, 2, 8 and 8′, as shown elsewhere in the drawing, even though this results in a reduction in the operating bandwidth of the secondary radar.

Figure 4:
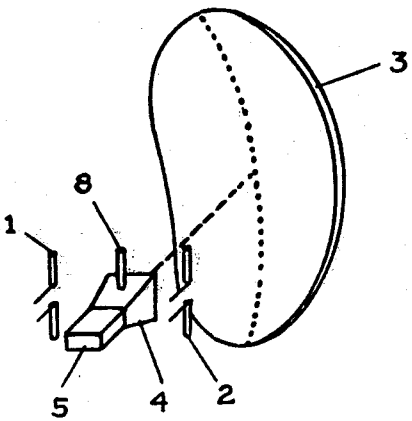

In cases where the two illuminating feeds are off-center in relation to the reflector (so-called offset illumination), as shown in FIG. 4, the corrective means may be restricted to a single rod 8. There is virtually no point in a second rod 8′ being present since the fields radiated by the lower part of the outer surface of elements 4 and 5 are not reflected at the paraboloidal segment 3.

In practice, if it is assumed that elements 4 and 5 (FIGS. 2a–2c) are of rectangular cross-section, the choice among a single corrector, a row of correctors or an array of correctors depends on the relative sizes of the sides a, b of the rectangular cross-section, parallel to planes $P_E$ and $P_H$, respectively, and wavelength $\lambda_B$.

In certain instances, with side b substantially smaller than side a, the coupling between structure 4, 5 and dipoles 1, 2 is small and there is no need for any correction.

Figure 8A:
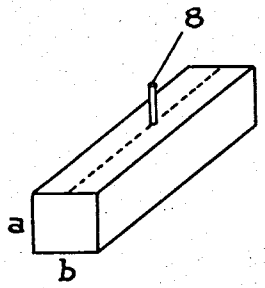
Figure 8B:
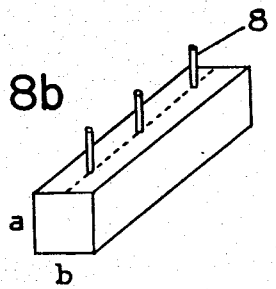

If, as they are in most cases, sides a and b are both less than wavelength $\lambda_B$ and are close to each other, I may use either a single corrective member situated in plane $P_E$ (FIG. 8a) or a row of corrective members in the same plane (FIG. 8b).

Figure 9A:
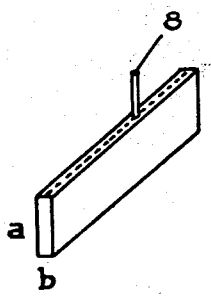
Figure 9B:
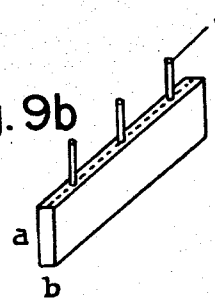

If wavelength $\lambda_B$ is appreciably greater than side b but substantially smaller than side a (FIG. 6b), the coupling between structure 4, 5 and dipoles 1, 2 is considerable and a single corrective member 8 as shown in FIG. 9a may prove inadequate. I therefore prefer in such cases to use a row (a main corrector followed by secondary correctors) lying in the plane $P_E$ as illustrated in FIG. 9*b*.

Figure 10B:
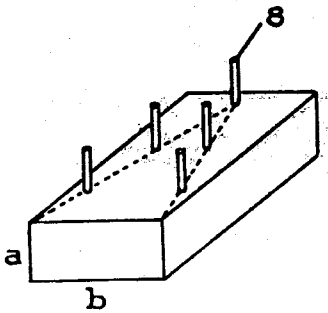
Figure 10A:
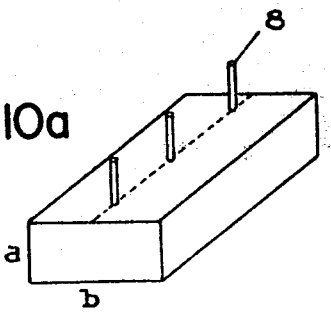

If wavelength $\lambda_B$ is substantially less than side b but greater than side a, a single row of correctors in plane $P_E$ (FIG. 10*a*) may be enough but it is preferable to use two rows which are symmetrical about plane $P_E$ and which may converge in a V at a common member, namely the main corrector 8 (FIG. 10*b*).

Although the principles of the present invention have been described above with reference to specific embodiments, it should be clearly understood that their description is given only by way of example and does not limit the scope of the invention. Thus, for example, the corrective members 8, 8′ may be coupled with the guide surface M via a large capacitance instead of being conductively connected thereto as shown.

I claim:

1. An antenna system comprising:

primary feed means including a conductive structure establishing a predetermined propagation path for radiation of a first frequency;

elongate secondary feed means skew to said path and independent of said primary feed means establishing a field of radiation of a second frequency close enough to said path to cause distortion of the radiation pattern of said second frequency by said structure; and corrective conductor means geometrically similar and parallel to said secondary feed means projecting from said structure generally transversely to said path at a location where currents induced in said structure by said field are substantially at a maximum.

2. An antenna system as defined in claim 1 wherein said structure includes a waveguide and said secondary feed means comprises a pair of dipoles flanking said waveguide.

3. An antenna system as defined in claim 2 wherein said dipoles are of the center-fed half-wave type.

4. An antenna system as defined in claim 2 or 3, further comprising a dished reflector with a concave surface confronting said primary and secondary feed means for illumination thereby, said waveguide terminating in a mouth proximal to said reflector.

5. An antenna system as defined in claim 4 wherein said conductor means comprises a member secured to said structure at a point spaced from said mouth by substantially a quarter-wavelength of said second frequency.

6. An antenna system as defined in claim 5 wherein said member lies in an elevational plane bisecting said structure and said reflector.

7. An antenna system as defined in claim 6 wherein said member and said dipoles are upright plates with major faces lying in vertical planes transverse to said elevational plane, said major faces having a width on the order of a quarter-wavelength of said first frequency.

8. An antenna system as defined in claim 5 wherein said member has an enlarged free end remote from said structure capacitively coupled to areas of said structure spaced from said point carrying significant induced currents.

9. An antenna system as defined in claim 6 wherein said structure has an axis at the intersection of said elevational plane with an azimuthal plane, said member being symmetrically duplicated at opposite sides of said azimuthal plane.

10. An antenna system as defined in claim 5 wherein said member is part of a group of substantially identical and parallel spaced-apart members constituting said conductor means.

11. An antenna system as defined in claim 10 wherein said members are linearly arrayed along said structure.

12. An antenna system as defined in claim 10 wherein said waveguide is of rectangular cross-section, said members rising from a major side of said waveguide in a V-shaped array having a vertex at said point, said major side having a width substantially exceeding the wavelength of said second frequency.

* * * * *